US005268954A

United States Patent [19]

Middleton

[11] Patent Number: 5,268,954

[45] Date of Patent: Dec. 7, 1993

[54] MOUNTING APPARATUS FOR DOUBLE CRYSTAL MONOCHROMATORS AND THE LIKE

[75] Inventor: Frederic H. Middleton, Madison, Wis.

[73] Assignee: Wisconsin Alumni Research Foundation, Madison, Wis.

[21] Appl. No.: 961,789

[22] Filed: Oct. 14, 1992

[51] Int. Cl.[5] ..... G21K 1/06

[52] U.S. Cl. ..... 378/85; 378/84

[58] Field of Search ..... 378/84, 85

[56] References Cited

U.S. PATENT DOCUMENTS

| | | |
|---|---|---|
| Re. 26,053 | 7/1966 | Cary . |
| 3,160,749 | 12/1964 | Spielberg . |
| 3,176,131 | 3/1965 | Romand et al. . |
| 3,384,756 | 5/1968 | Hasler et al. . |
| 3,418,051 | 12/1968 | Staunton . |
| 3,445,653 | 5/1969 | Tomura . |
| 4,365,156 | 12/1982 | Golovchenko et al. . |
| 4,398,823 | 8/1983 | Brown et al. . |
| 4,446,568 | 5/1984 | Williams et al. . |
| 4,462,689 | 7/1984 | Kabler et al. . |
| 4,490,041 | 12/1984 | Riemer . |
| 4,553,253 | 11/1985 | Petersen . |
| 4,580,283 | 4/1986 | Hornstra . |
| 4,637,041 | 1/1987 | Brinkgreve et al. . |
| 4,698,833 | 10/1987 | Keem et al. . |
| 4,752,945 | 6/1988 | Jenkins et al. . |
| 4,882,780 | 11/1989 | Wittry . |
| 4,885,760 | 12/1989 | Van Tol et al. . |
| 5,157,702 | 10/1992 | Middleton et al. . |

OTHER PUBLICATIONS

J. A. Golovchenko, et al., "X-Ray Monochromator System for Use With Synchrotron Radiation Sources," Rev. Sci. Instru., vol. 52, No. 4, Apr. 1981, pp. 509-516.

D. M. Mills, et al., "A Fixed Exit Sagittal Focusing Monochromator Utilizing Bent Single Crystals," Nuclear Instruments and Methods in Physics Research, A246, 1986, pp. 356-359.

D. Shu, et al., "UHV Compatible Compact Double--Crystal Monochromator at BEPC Diffraction and Scattering Beamline 4B9A," Rev. Sci. Instrum. vol. 60, No. 7, Jul. 1989, pp. 2054-2057.

S. L. Hulbert, et al., "An Ultrahigh-Vacuum Multiple Grating Chamber and Scan Drive With Improved Grating Change," Nuclear Instruments and Methods in Physics Research, A291, 1990, pp. 343-347.

(List continued on next page.)

*Primary Examiner*—Craig E. Church

*Attorney, Agent, or Firm*—Foley & Lardner

[57] ABSTRACT

A mounting mechanism for a double crystal monochromator or the like has a parallelogram based mounting mechanism in which two of the vertices of the parallelogram are fixed in position, and two vertices are free to translate back and forth in a straight line parallel to the fixed base of the parallelogram. One diffractor is mounting for pivoting at one of the fixed vertices, and the second diffractor is mounted for pivoting at an adjacent movable vertex. The surfaces of the diffractors are maintained parallel as the angle of the diffractors with respect to input and output beams to the monochromator is changed to change the wavelength being passed. The diffractor mounted at the fixed pivot may be connected to a large diameter wheel which in turn is connected by a band to a smaller diameter wheel mounted for rotation at the other fixed vertex of the parallelogram, with a pivotable arm connected to the smaller wheel to rotate therewith. Another larger diameter wheel is connected to the diffractor at the movable vertex and is connected by a band to a smaller diameter wheel at the adjacent movable vertex of the parallelogram, where the smaller wheel is connected by a slider to the pivotable arm. As the movable diffractor is translated in position, the arm pivots to cause the small wheels to move through the same angle of angular displacement as the pivotable arm. The corresponding angular displacement of the diffractors may be one half the angular displacement of the pivotable arm where the larger wheels are twice the diameter of the smaller wheels.

17 Claims, 8 Drawing Sheets

OTHER PUBLICATIONS

Article entitled "Chamber Allows Changes in Grating Position," Design News, Feb. 12, 1990, pp. 154–155.
C. Kunz, et al., "A Grazing Incidence Vacuum Ultraviolet Monochromator with Fixed Exit Slit," Rev. Sci. Instrum., vol. 43, No. 3, Mar. 1972, pp. 434–442.
Y. Xie, et al., "A Double-Crystal Monochromator for EXAFS at BSRL," Rev. Sci. Instrum., vol. 63, No. 1, Jan. 1992, pp. 956–957.
H. Tolentino, et al., "High-Resolution Monochromator for Soft and Hard X-Rays," Rev. Sci. Instrum., vol. 63, No. 1, Jan. 1992, pp. 946–949.
J. P . Kirkland, "HV-Compatible Fixed-Exit Two/-Four Crystal Monochromator," Nuclear Instruments and Methods in Physics Research, A291, 1990, pp. 185–191.
T. Iwazumi, et al., "Double-Crystal Monochromator for High-Power and High-Energy Synchrotron Radiation," Rev. Sci. Instrum., vol. 63, No. 1, Jan. 1992, pp. 419–422.
B. X. Yang, et al., "Double-Crystal Monochromator Beam Line on the Alladin 1-GeV Storage Ring," Rev. Sci. Instrum., vol. 63, No. 1, Jan. 1992, pp. 1355–1358.
M. Correa, et al., "A Two-Crystal Monochromator for the UVX Ring of LNLS," Rev. Sci. Instrum., vol. 63, No. 1, Jan. 1992, pp. 896–898.
R. F. Garrett, et al., "A High-Energy Double-Crystal Fixed Exit Monochromator for the X17 Superconducting Wiggler Beam Line at the NSLS," Rev. Sci. Instrum., vol. 63, No. 1, Jan. 1992, pp. 595–598.

MOUNTING APPARATUS FOR DOUBLE CRYSTAL MONOCHROMATORS AND THE LIKE

FIELD OF THE INVENTION

This invention pertains generally to the field of monochromators, such as those used with synchrotron X-ray sources, and particularly to mounting mechanisms for monochromators and similar mechanisms.

BACKGROUND OF THE INVENTION

Monochromators are used to selectively filter an electromagnetic radiation beam so that only a single wavelength or a narrow band of wavelengths is passed by the monochromator. A common type of monochromator utilizes two diffractors, with the input beam diffracted by both to form an output beam which is parallel to the input beam but substantially restricted to a single wavelength. In the visible light range, where the wavelengths are relatively long, diffraction gratings may be used as diffractors. Monochromators which cover a shorter wavelength range, such as in the X-ray region, may use diffractor elements which are formed of single crystals, commonly of silicon or germanium, or multi-laminar layered mirrors that behave in the same manner as crystals.

In an article by J. A. Golovchenko, et al. entitled "X-ray Monochromator System for Use with Synchrotron Radiation Sources," Review of Scientific Instruments, Vol. 52, No. 4, April, 1981, pp. 509–516, a double crystal monochromator is described in which each crystal is oriented to obtain a constant energy or direction as well as a constant beam position as the selected beam energy is varied, and to make the central ray of the beam impinge at the same point on each monochromator crystal independently of the chosen energy. This is achieved in part by sampling the output beam intensity for angular drifts out of parallelism between the two crystals, with an electronic drive then used to correct orientation of the beam. The crystals are mounted on a mounting element composed of two bars joined at a right angle in an "L" shape, with one crystal mounted parallel to one bar and the other mounted perpendicular to the other bar, so that the two crystals are held parallel to one another. The L-shaped mounting member rotates with one of the crystals about the same axis of rotation, to change the wavelength passed by the crystal, while the joint between the two legs of the L and the second crystal both translate along a straight line parallel to the input and output beams. Precision sliders are required between the mounts for the crystals and the mounting bars, as well as at the point at which the center of the L shaped mounting member is supported for translation.

An improved monochromator mounting mechanism is shown in the U.S. Pat. No. 5,157,702 to Middleton and Hicks, issued Oct. 20, 1992, entitled "A Mechanically Actuated Double Crystal Monochromator." The monochromator shown in that patent is designed for operation in high vacuum so that it can be mounted to a synchrotron, and includes precision mechanical parts for allowing the crystal mounting assemblies to slide in precise relation to one another.

In the foregoing systems, the parallelism of the faces of the diffracting crystals is maintained by mounting them on the L-shaped mounting member which is mounted on rotating sliders. Highly precise sliders are required in the structure since the orientation of the crystal is dependent upon the precision of the sliders, which contributes to the complexity and cost of the monochromator instrument.

SUMMARY OF THE INVENTION

A mounting mechanism for a double-crystal monochromator or the like in accordance with the present invention utilizes a parallelogram based mounting mechanism in which two of the vertices of the parallelogram are fixed in position along a base, and two other vertices are free to translate back and forth in a straight line parallel to the fixed base of the parallelogram. A first mounting member for one of the diffractor elements is mounted for pivoting at one of the fixed vertices of the parallelogram, and a second mounting member is mounted for pivoting at the adjacent movable vertex of the parallelogram. The surfaces of the two diffractors are maintained parallel to one another as the angle of the diffractors with respect to the input and output beams is changed to change the wavelength passed by the monochromator. The mounting members for the diffractors are operatively connected so that the change in the angle of incidence on, and reflection from the diffractors is one-half of the change in angle of a pivotable arm forming one side of the parallelogram.

In a preferred structure for operatively connecting the mounting members, a large diameter wheel is connected to each mounting member to pivot around an axis which lies on the surface of the diffractor which the mounting member supports. Wheels having half of the pitch diameter of the larger wheels are mounted at the other two vertices of the parallelogram, and bands connect each pair of larger and smaller wheels so that the large and small wheels move together, with each small wheel undergoing an angular displacement twice that of the large wheel to which it is connected. The small wheel at the fixed pivot point is connected to the arm forming one side of the parallelogram so that the wheel and the arm undergo the same angular displacement about the pivot. The small wheel connected at the movable pivot point of the parallelogram is connected to the arm so that the wheel undergoes the same angular displacement as the arm. Consequently, rotation of the pivotable arm of the parallelogram will result in pivoting of the diffractors by an angle exactly equal to one half of the angular displacement of the pivotable arm.

In the present invention, sliders are required only at the movable pivot point at the vertex of the parallelogram to which the small wheel is mounted and for the movable support on which the small and large wheels are mounted for translation. Thus, only two slider mechanisms are required in the present invention. Moreover, the translational support for the large and small wheels at the two moving vertices of the parallelogram can be provided by a support rod which extends outside the vacuum chamber enclosure required for applications requiring high vacuum, as with an X-ray synchrotron. Support of the sliding mechanism outside the vacuum chamber allows the use of less expensive components of the type which can be lubricated, which is not the case where the sliding supports must be mounted within the vacuum chamber. Consequently, high precision in the positioning and rotation of the mounting members, and the diffractors or mirrors supported thereon, can be obtained with relatively low cost components.

The present invention may also be embodied in a plane grating monochromator in which a mirror is mounted to the movable vertex of the parallelogram structure and a diffraction grating is mounted for pivoting independently of rotation of the mirror. The parallelogram mounting apparatus of the invention orients the mirror so that the incoming beam is properly directed to the grating at all angles of incidence.

Further objects, features and advantages of the present invention will be apparent from the following detailed description when taken in conjunction with the accompanying drawings.

DETAILED DESCRIPTION OF THE INVENTION

Figure 1:
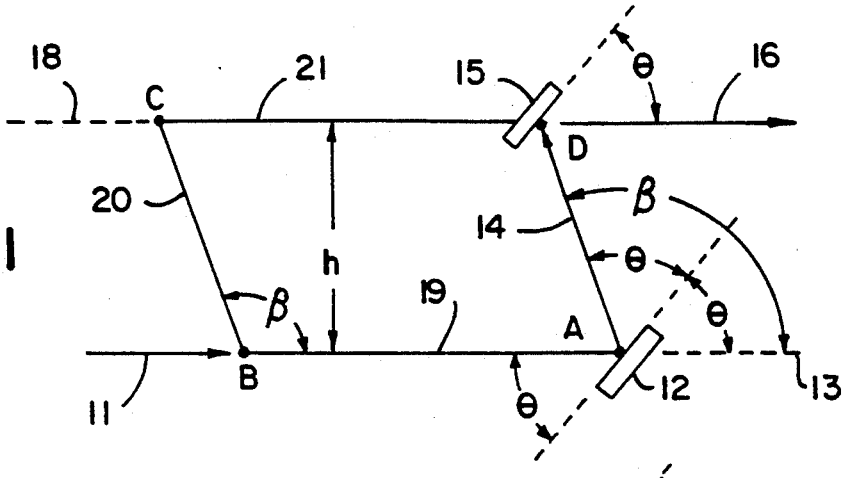
FIGS. 1–3 are schematic views showing exemplary positions of diffractor elements with respect to the parallelogram support mechanism of the present invention.

In a double diffractor monochromator, including double crystal monochromators used with X-ray beams, the input beam typically is received along a known axis and meets the surface of the first diffractor element at an angle. Generally, the diffractor will reflect a selected wavelength at an angle of reflection equal to the angle of incidence, while reflecting other wavelengths at other angles. The second diffractor element is positioned so that the angle of incidence of the beam at the selected wavelength is the same as the angle of incidence on the first diffractor element. The beam at this wavelength is then reflected from the second diffractor element in an output beam having a direction preferably parallel to the input beam. The output beam may then be utilized for various purposes. Wavelengths other than the selected wavelength which are reflected from the first diffractor, if incident upon the second diffractor element, are reflected from the second element in directions other than that of the output beam.

By rotating the diffractor elements with respect to the input and output beams so that the angle of incidence changes, the band of wavelengths passed through the double diffractors will change, and thus the wavelength or band of wavelengths in the output beam can be scanned over a substantial portion of the spectrum of the input beam by rotating the diffractor elements from a maximum angle of incidence to a minimum angle of incidence. Finely ruled diffraction gratings may be used as the diffractor elements for visible and near visible light, whereas crystals having a regular lattice structure, such as single crystal silicon, often are used as the diffractor elements at higher energies as in X-ray regions. Whichever type of diffractor element is used, the mounting mechanism for the diffractors requires that the faces of the diffractor elements be maintained as nearly perfectly parallel to one another as possible while the diffractor elements are rotated, that the beam at the selected wavelength reflected from the first element be incident on the second element at the same position at all angles, and preferably that the output beams for all angles of the diffractors be congruent.

For double crystal monochromators of the type utilized with X-ray radiation from a synchrotron, additional requirements are imposed on the system. Typically, the monochromator will be connected to the synchrotron with the interior of the monochromator in communication with the evacuated interior of the synchrotron ring. The mechanical parts of the monochromator support mechanism must be capable of being operated in a vacuum, which imposes special constraints on such mechanical parts. For example, moving parts within the vacuum enclosure cannot ordinarily use lubricants which would tend to sublimate and be deposited on other parts within the monochromator, including the diffractors themselves. Consequently, expensive bearings and slide structures are required for a support mechanism which is mounted within the vacuum enclosure. It is thus desirable to minimize the support requirements for the mechanical parts. Nonetheless, it is necessary that the support mechanism support the diffractors with high precision throughout their range of motion since even small misalignments can result in misdirection of the output beam from its desired position, or improper selection of the wavelengths passed by the monochromator.

The double diffractor monochromator support mechanism of the present invention addresses these requirements by utilizing a parallelogram support apparatus to coordinate the motion and rotation of the diffractor elements. The principles of the present invention may be illustrated with respect to the schematic views of FIGS. 1–3. In these figures, an input beam 11 of electromagnetic radiation (e.g., a broad band of X-ray wavelengths) is incident on a first diffractor element 12 at an angle of incidence $\theta$ with respect to the face of the diffractor element 12, and a beam 14, at a selected wavelength, is reflected from the diffractor 12 at the same angle $\theta$ as the angle of incidence. The selected wavelength beam 14 is incident on a second diffractor element 15 and is reflected from the element 15 into an output beam 16 at an angle of reflection $\theta$ which is equal to the angle of incidence. In the view of FIG. 1, the angle of incidence is at the highest angle of those shown in FIGS. 1-3; in FIG. 2 at an intermediate angle (a 45° angle of incidence shown); and, in FIG. 3, at the lowest angle. The input beam 11 and the output beam 16 preferably remain parallel as the angles of the diffractor elements change; moreover, it is preferred the output beams at each of the angles of the diffractor elements be congruent to each other.

Figure 2:
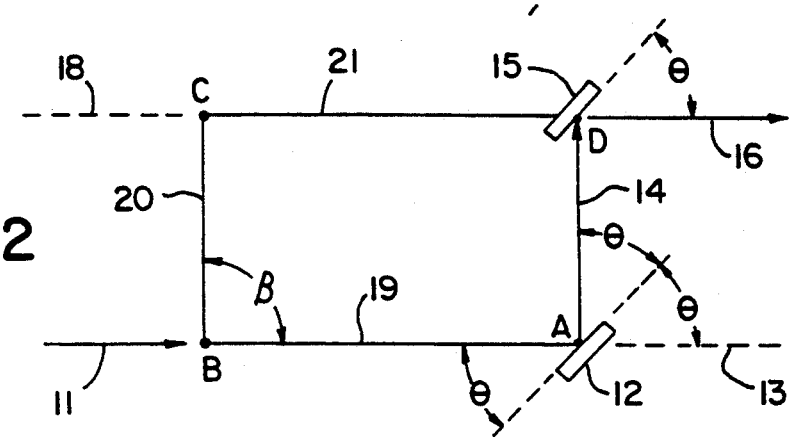
Figure 3:
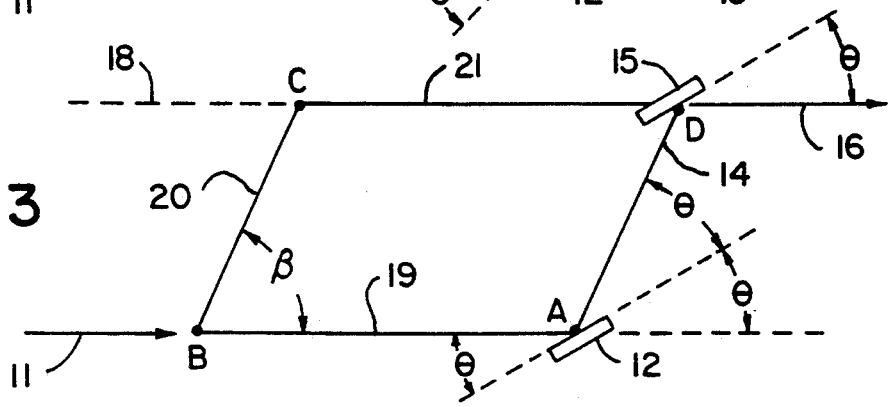

In the support mechanism of the present invention, an effective parallelogram is formed which has four vertices, marked A, B, C and D in FIGS. 1-3. Vertex A lies on the face of the first diffractor element 12 and on the axis of rotation of this element. Vertex D similarly lies on the axis of rotation of the second diffractor element 15 at the face of this element. Vertex A and vertex B are fixed in position at the ends of a base 19 and lie on a line 13 which is parallel to the input beam 11, while vertices C and D lie on a line 18 parallel to the output beam 16 and can translate along this line as the diffractor elements 12 and 15 are pivoted about their axes. As is apparent from the figures, the angle $\beta$ that the reflected beam 14 makes with respect to the line 13 and the input beam 11 is equal to $2\theta$. A similar angle $\beta$ is made between the side 20 of the parallelogram, which connects the vertices B and C, and the base side 19. It is thus seen that as the diffractor elements are moved and rotated from the position shown in FIG. 1 to the position shown in FIG. 3, the change in the angle $\theta$ is one-half the change in the angle $\beta$—a decrease in the angles as the diffractor elements are moved from the position shown in FIG. 1 to FIG. 3, or an increase in the angles with rotation of the diffractor elements in the opposite direction. The height above the base 19 of the upper parallelogram side 21, which lies on the line 18 parallel to the output beam 16, remains constant as the diffractor elements rotate and the points C and D translate. The separation between the points C and D, and between the points A and B, is constant and, of course, equal. In the present invention, the operative connection between the pivotable side 20 and the upper side 21 at the vertex C results in proper translation of the vertices C and D to maintain the parallelogram relationship as the angle $\beta$ changes. Thus, the reflected beam 14 will lie on a line between the vertices A and D.

In the present invention, the mounting member for the diffractor element 12 is operatively connected to the side 20 so that a change in the angle $\theta$ of incidence on the diffractor results in a change in the angle $\beta$ by twice that of the angle $\theta$, and vice versa. In addition, the side 20 is operatively connected to the mounting member for the second diffractor element 15 so that a change in the angle $\beta$—which is also the angle at which the side 20 intersects the upper parallelogram side 21 at the vertex C —results in half that angular change in the angle $\theta$ of the diffractor element 15.

Figure 4:
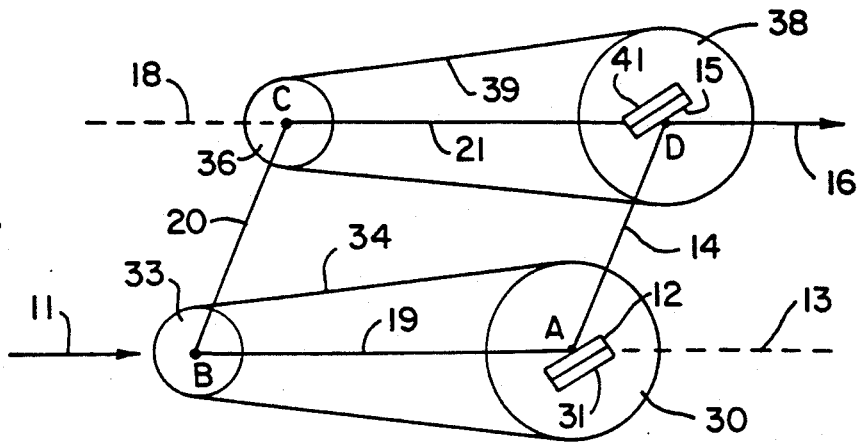
FIG. 4 is a schematic view of the parallelogram support mechanism of the present invention utilizing wheels and bands to transmit rotation from one diffractor element to the other to maintain parallelism between them.

An exemplary mechanism for carrying out the foregoing operative connection between the diffractor element 12 and the diffractor element 15 is shown in FIG. 4. In this embodiment, a first wheel 30, having a chosen pitch diameter $D_1$, is mounted for rotation about a fixed axis which passes through the point A, and is attached to a mounting member 31 for the diffractor 12 so that the wheel 30, the mounting member 31, and the diffractor 12 pivot about the same axis passing through the point A. A second wheel 33, having a pitch diameter one-half $D_1$, is mounted to pivot about a fixed axis which passes through the vertex B. A band 34 extends around the circumferential periphery of the wheels 30 and 33 and is tightly engaged to the periphery of each so that the two wheels rotate together. Because the wheel 33 has a pitch diameter half that of the wheel 30, an angular displacement of the wheel 30 will result in an angular displacement of the wheel 33 of twice the angle through which the wheel 30 is displaced. The wheel 33 is connected to a rigid arm forming the parallelogram side 20 so that the wheel 33 and the arm 20 rotate together about an axis which passes through the vertex B. The connection between the wheel 33 and the arm 20 thus ensures that the angle $\beta$ which the arm 20 makes with the base 19 will change at twice the rate as the angle $\theta$ which the diffractor element 12, and the mounting member 31, make with regard to the line 13 congruent with the base 19.

A third wheel 36 is mounted on a translating support frame, which provides the parallelogram side 21, to pivot about the vertex C. The wheel 36 is connected to the arm 20 through a sliding connection so that the wheel will rotate about the vertex C as the arm 20 pivots about the vertex B, and will undergo the same angular displacement as that of the arm 20 above the pivot point B. The wheel 36 has a pitch diameter $\frac{1}{2}$ $D_2$, and the pitch diameter $D_2$ may be but need not be the same as the diameter $D_1$ of the wheel 33. A fourth wheel 38 is mounted to the movable frame 21 to pivot about an axis passing through the vertex D and has a pitch diameter equal to $D_2$. A band 39 is tightly engaged about the circumferential periphery of the wheels 36 and 38 to cause the two wheels to rotate together. Thus, an angular displacement of the wheel 36 will result in twice that angular displacement of the wheel 38. The wheel 38 is connected to a mounting member 41 for the second diffractor element 15 so that the wheel 38, the mounting member 41, and the diffractor 15 all rotate together about an axis passing through the vertex D. The vertices C and D are thus formed on the movable frame 21 which is mounted to slide in translation and move the vertices C and D along the line 18 which is parallel to the output beam from the monochromator.

From the foregoing, it is seen that when the wheel 30 is displaced by angle $\Delta\theta$, the arm 20 will be displaced by an angle $2\Delta\theta$, which will result in a translation of the vertex C—and thus the vertex D since these are connected together by the upper parallelogram side 21—in such a way that the beam 14 will also undergo an angular displacement with respect to the line 13 of $2\Delta\theta$. In addition, the wheel 36 will rotate through an angle equal to $2\Delta\theta$, which will result in rotation of the wheel 38, and therefore the mounting member 41 and diffractor 15 connected thereto, through an angular displacement $\Delta\theta$. Consequently, the surfaces of the diffractors 12 and 15 will remain in parallelism as these elements are rotated.

It is apparent, of course, that the relative position of the diffractors 12 and 15 with respect to the input beam 11 and output beam 16 may be reversed. In addition, it is also apparent that the vertices C and D may be the fixed vertices, with the vertices A and B being translatable by interchanging various of the elements as described above.

Figure 5:
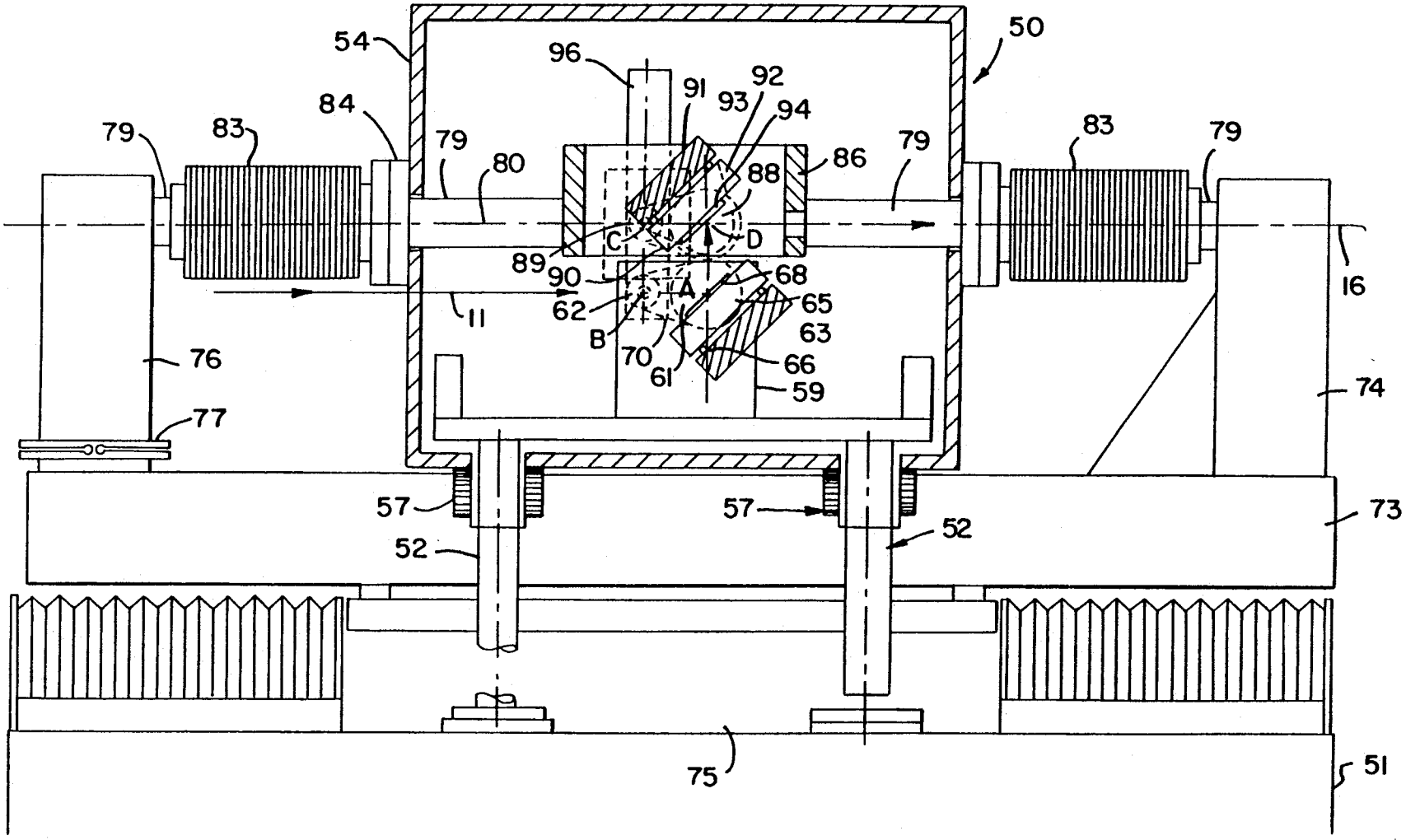
FIG. 5 is a side view, partially in section, of a support mechanism for a double-diffractor monochromator or the like adapted to receive radiation from a synchrotron.

An exemplary mounting apparatus in accordance with the invention incorporated in a double crystal monochromator for use with X-ray sources such as synchrotron is shown generally at 50 in FIG. 5. The apparatus is mounted on a stable base 51, which may be formed, e.g., of granite, and has support legs 52 which extend through a vacuum chamber enclosure 54 to attach to and support an internal support frame 55.

Bellows 57 are welded between the legs 52 and the vacuum chamber enclosure 54 to seal off the interior of the vacuum chamber from the external ambient atmosphere while allowing the legs 52 to support the internal support frame 55 independently of the vacuum chamber enclosure 54. The chamber enclosure 54 is separately supported by support legs (not shown) so that the components within the vacuum chamber are not subject to vibrations or thermal effects from the vacuum chamber enclosure. A support column 59 extends upwardly from the internal support frame 55 so that it is rigidly mounted thereto. A first wheel 61, of larger pitch diameter, and a second wheel 62, of half the pitch diameter of the wheel 61, are pivotally mounted in fixed position to the support column 59. A lower scan housing 63 is connected to the larger diameter wheel 61. A lower crystal support 65 is mounted by K-mounts 66 to the lower scan housing 63, and supports a monochromator crystal 68 which has a face lying on an axis passing through the pivot point A about which the wheel 61 is mounted for rotation. The wheel 61 is connected by a band 70 to the wheel 62 so that the two wheels rotate together in the manner described above.

A horizontal base frame 73 is mounted to a linear slide 75 that is mounted on the granite base 51 and has an upright support column 74 at one end thereof. At the other end, a support column 76 is connected by a flexural hinge 77 to the horizontal base frame 73. A push-pull support rod 79 is mounted between the support columns 74 and 76. The flexural hinge 77 allows thermal expansion differences between the horizontal base frame 73 and the push-pull support rod 79. The support rod 79 can translate back and forth along a horizontal line 80 as the linear slide 75 moves the horizontal base frame 73 back and forth. Bellows 83 are welded to the support rod 79 and to flanges 84 attached to the vacuum enclosure 54 to provide a flexible but airtight seal between the support rod 79 and the interior of the vacuum chamber enclosure 54. Thus, the support rod 79 can slide back and forth, driven from a position outside the vacuum chamber, and will translate freely within the vacuum chamber enclosure 54.

Within the vacuum chamber, a translating support frame 86 is attached to the support rod 79 to translate back and forth with it. A larger diameter wheel 88 is mounted for rotation to the support frame 86 about an axis which passes through the vertex point D. A smaller wheel 89, half the pitch diameter of the wheel 88, is mounted for rotation to the support frame 86 to rotate about an axis which passes through the vertex point C. A band 90 is engaged to the circumferential periphery of the wheels 88 and 89 so that these two wheels rotate together.

An upper scan housing 91 is connected to the wheel 88 to rotate therewith, and a crystal support 92 is connected by K-mounts 93 to the upper scan housing 91. An upper diffractor crystal 94 is mounted to the crystal support 92 with its face lying on the axis of rotation passing through the vertex D.

A straight edge arm 96 is mounted for rotation to the support column 59 and is connected to the wheel 62 to rotate about an axis passing through the vertex point B. Thus, angular displacement of the wheel 62 will result in equal angular displacement of the straight edge arm 96. The straight edge arm 96 is also connected to the translating support frame 86 by a sliding connector (not shown in FIG. 5) so that the straight edge arm 96 will rotate as the support frame 86 is translated back and forth. Generally, the connection of the straight edge arm 96 to the support frame 86 is such that the vertex point B, fixed to the support column 59, and vertex C fixed to the translatable support 86, lie on a line which is parallel to the center of the straight edge arm 96.

The input beam 11, which generally will be a broad band of X-rays, is received from a synchrotron through connecting tubes (not shown) into the vacuum chamber enclosure 54 of the monochromator and impinges upon the face of the lower crystal 68 at about the point A. This beam is reflected upwardly to impinge on the face of the upper crystal 94 and is reflected at the selected wavelength in the output beam 16 on a line which is substantially parallel to the center line 80 of the support rod 79.

It will be seen that as the support rod 79 is translated to the left from its position shown in FIG. 5, the straight edge arm 96 will be rotated to the left, causing the wheel 62 to rotate to the left and rotating the wheel 61 (and thereby the crystal 68) through half the angular displacement of the straight edge arm 96. Moreover, the wheel 89 will be rotated through the same angle as the straight edge arm 96, and the wheel 89, and the crystal 94, will be rotated through one-half the angular displacement of the straight edge arm. Thus, the faces of the upper and lower crystals will remain in parallelism as the upper crystal is translated to the left and both crystals are rotated. An opposite direction of rotation of the crystals will occur when the rod 79 is translated to the right. Because the support rod 79 is mounted via columns 74 and 76 to bearings within the linear slide 75 which lie outside of the vacuum enclosure, these bearings can be conventional bearings which may be lubricated in a normal manner. Such bearings are generally less expensive than the bearings that would be required for use within the vacuum enclosure, and are more readily maintained. The flexural hinge 77 allows differential thermal expansion of the support rod 79 relative to the horizontal base frame 73.

Figure 6:
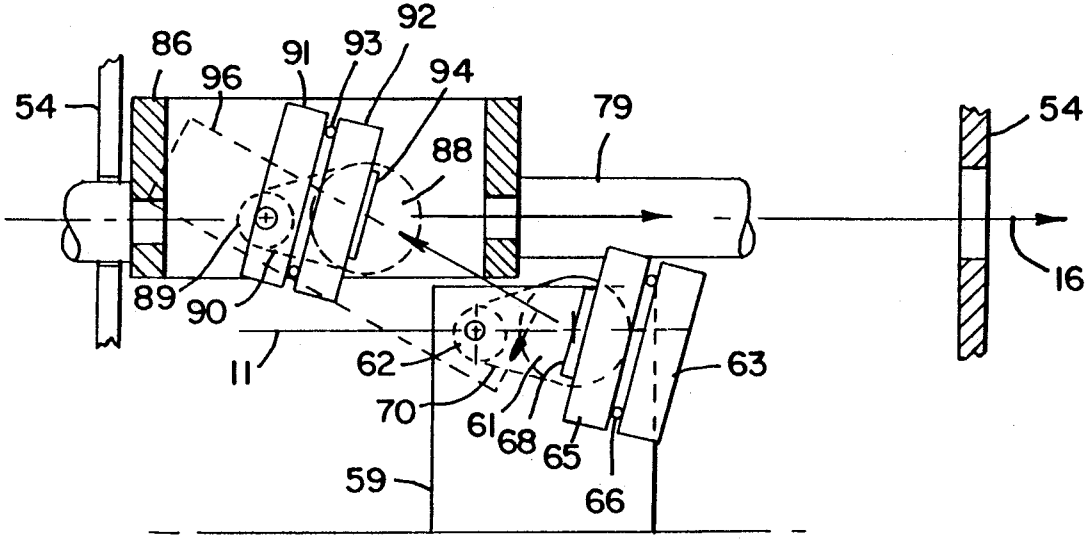
FIG. 6 is a side view of the diffractor support members in the mechanism of FIG. 5 shown in their highest angle of incidence position.
Figure 7:
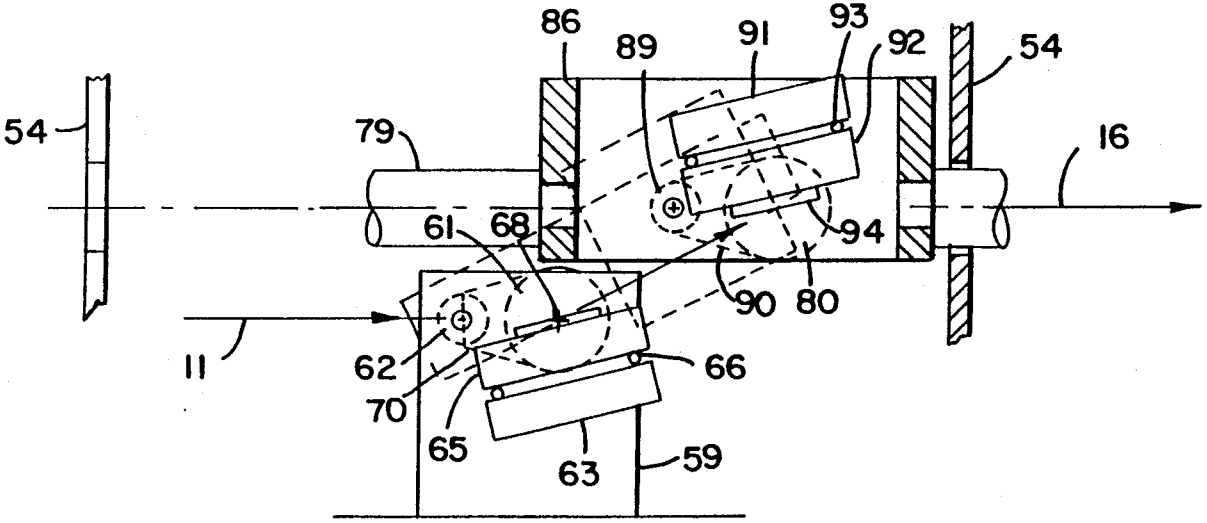
FIG. 7 is a side view of the diffractor support members similar to the view of FIG. 6 but with the diffractor support members in their lowest angle of incidence position.

The extreme positions of the translating support frame 86 of the apparatus 50 are shown in FIGS. 6 and 7. In FIG. 6, the translatable support frame 86 is shown at its left-most position, in which the crystals 68 and 94 meet the input and output beams 11 and 16, respectively, at the highest angles of incidence and reflection. FIG. 7 shows the right-most position of the translatable support frame 86 in which the crystals 68 and 94 meet the input and output beams 11 and 16, respectively, at the lowest angle of incidence and reflection. The mechanism of the present invention maintains the parallelism of the surfaces of the crystals 68 and 94 throughout their range of rotation and throughout the travel of the crystal 94. It is noted that, in the apparatus 50, only one linear bearing in the vacuum is required, at the position at which the straight edge arm 96 is engaged to the translatable support frame 86.

Figure 8:
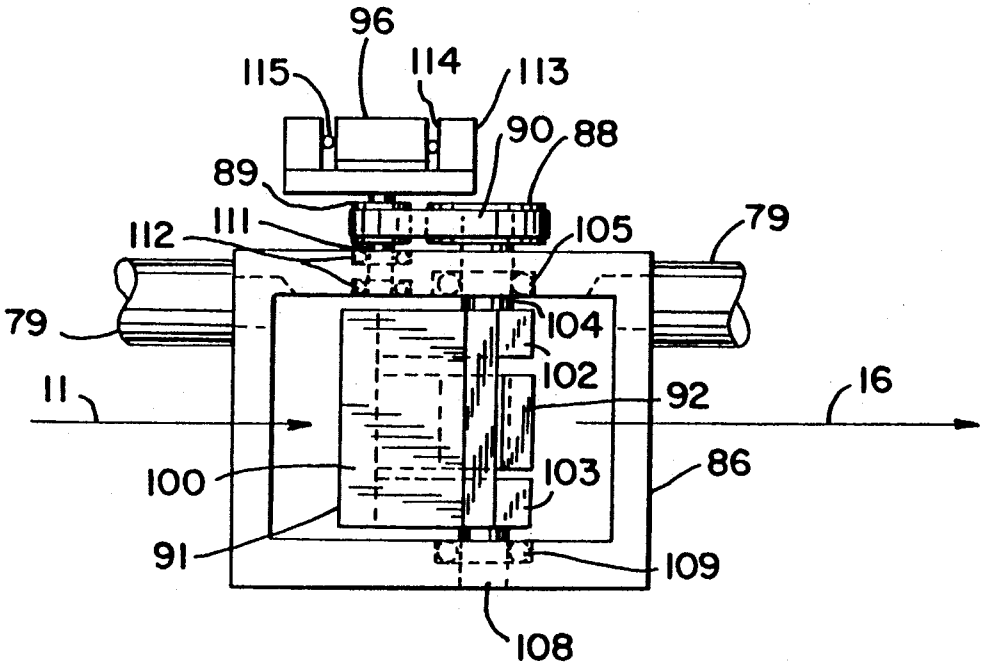
FIG. 8 is a top view of the translation support frame and adjacent parts of the apparatus of FIG. 5.

The connection between the pivoting straight edge arm 96 and the translating support frame 86 is illustrated in the view of FIG. 8, which is a top view of the support frame 86 and portions of the structure connected to it. As may be seen in FIG. 8, the upper scan housing 91 comprises a generally U-shaped member having a base 100 and legs 102 and 103. A shaft 104 is connected to one of the legs 102 and is mounted for rotation in a bearing 105. The wheel 88 is also mounted to the shaft 104 for rotation with the shaft 104. Another shaft 108 is connected to the other leg 103 of the upper scan housing 91 and is supported for rotation in a bearing 109 which is mounted to the translatable support frame 86. The upper crystal support 92 is mounted to the base 100 of the upper scan housing 91. The lower scan housing 63 is constructed and mounted to the support column 59 in a similar manner.

The smaller upper wheel or pulley 89 is mounted on a shaft 111 which is supported for rotation by bearings 112 mounted to the translating support frame 86. The band 90 connects the wheels 88 and 89 so that they rotate together. Because of the relatively limited range of rotation required of the wheels 88 and 89, the band 90 may be fixed to the periphery of each of the wheels 88 and 89 by a cleat (not shown) or other suitable means. The range of rotation required of the wheels is limited, and at least one point on each of the wheels 88 and 89 which will always be in contact with the band over the complete range of rotation of the wheels. Consequently, the band may be mechanically fixed to the wheels by a connector such as a cleat so that no slipage of the band with respect to the wheels can occur. It is thus apparent that partial sections of a wheel may be used instead of a full wheel, as well as other equivalent structures for transferring translation to rotation, and vice versa, and may be considered "wheels" as used herein.

A pivoting slider 113 is also mounted to the shaft 112 to rotate therewith and has sidewalls defining an inner linear bearing channel 114. The arm 96 is engaged within the channel 114, for example, by linear ball or roller bearings 115, so that the straight edge arm 96 can translate freely within the channel 114 and will rotate with or cause rotation of the pivoting slider 113.

In a monochromator for use with synchrotron radiation, cooling of the diffractor crystals may be provided in any suitable fashion. An example of the cooling structure is set forth in the aforesaid U.S. Pat. No. 5,157,702 which is incorporated herein by reference.

Figure 9:
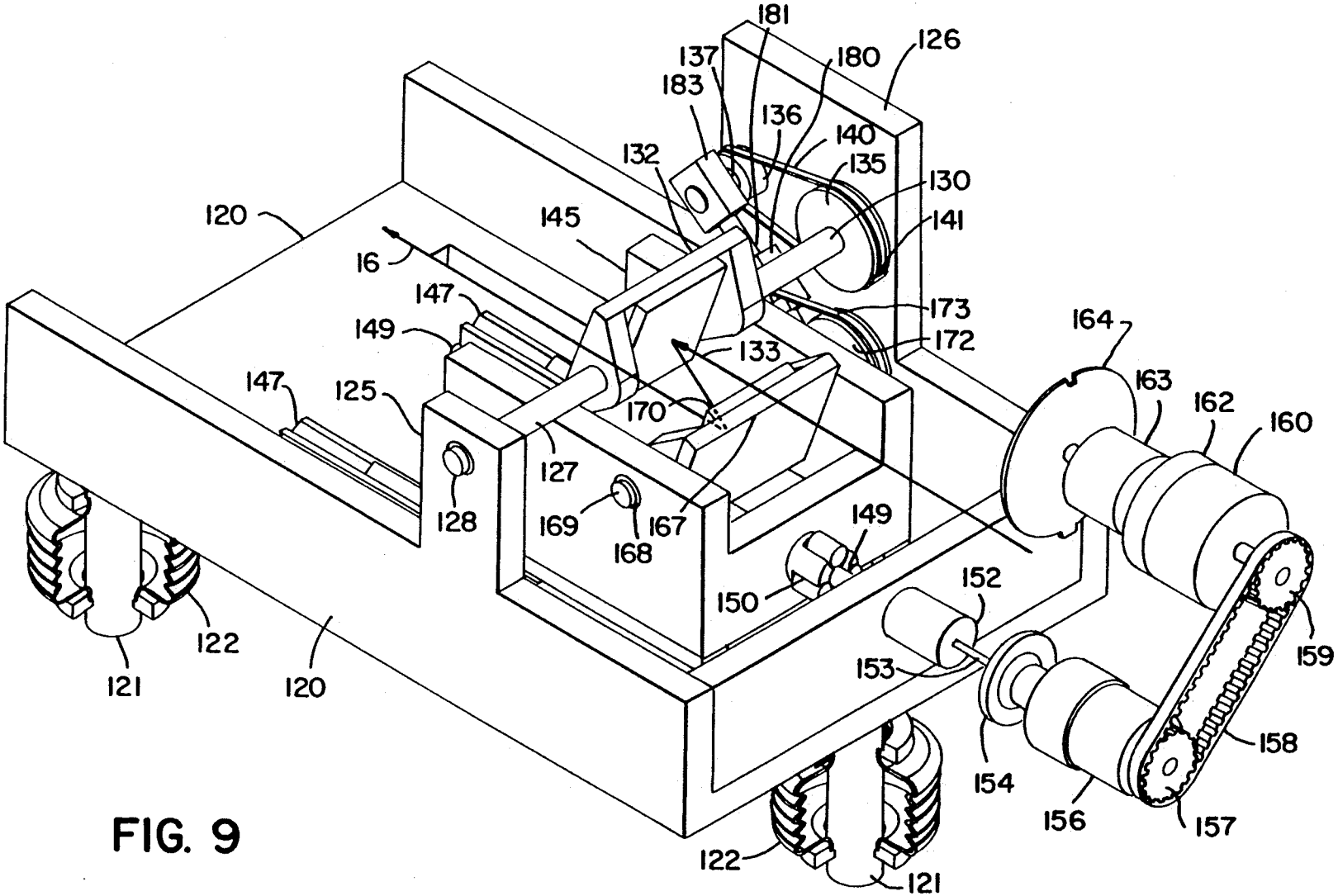
FIG. 9 is a perspective view of an exemplary mechanism in accordance with the present invention having a carriage supported for transverse movement within the vacuum chamber housing.
Figure 10:
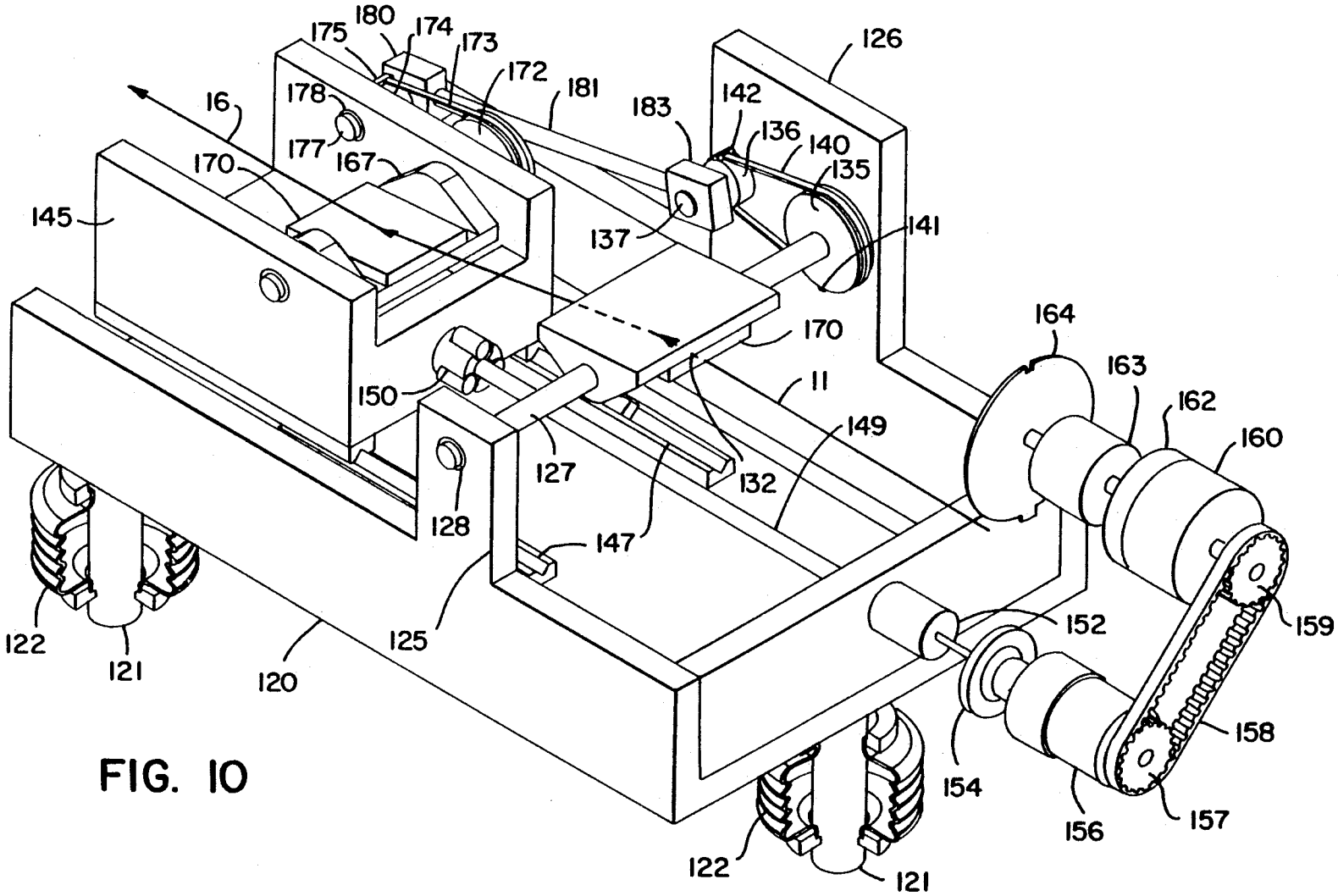
FIG. 10 is a view of the mechanism of FIG. 9 with the carriage moved to the lowest angle of incidence position.

Various other arrangements are also possible for the mounting of the translatable elements within the vacuum chamber and for the driving of the translatable elements. An exemplary apparatus is shown in FIG. 9 without the vacuum chamber enclosure. The embodiment of FIG. 9 has an internal support platform 120 which is supported by support legs 121 which extend to a support base (not shown) with welded bellows seals 122 sealing the support leg to the vacuum enclosure (not shown in FIG. 9). A pair of support columns 125 and 126 extend upwardly from the internal support platform 120. A shaft 127 is supported for rotation in a bearing 128 which is mounted to the support column 125, and a shaft 130 is mounted for rotation by a similar bearing (not shown) to the support column 126. An upper scan housing 132 is mounted between the shafts 127 and 130 to rotate with the shafts about a central axis. An upper crystal support and an upper crystal (shown as a crystal unit 133) are mounted to the upper scan housing to rotate with it. The axis of rotation of the shafts 127 and 130 lies on the surface of the crystal 133. A larger diameter upper wheel 135 is also mounted to the shaft 130 for rotation, and a smaller diameter wheel 136 (half the pitch diameter of the wheel 135) is mounted to a shaft 137 which is supported for rotation by a bearing (not shown) mounted to the support column 126. The wheels 136 and 135 are connected by a band 140 which may be attached by a cleat 141 to the larger wheel 135 and by a similar cleat 142 (shown in FIG. 10) to the smaller wheel 136.

A linear carriage 145 acts as the translating support frame and is supported for translation on the support platform 120 by linear slides 147 having crossed roller ways. A lead screw 149 is mounted within the vacuum enclosure and is engaged to the carriage 145 by an all-rolling contact "V" roller nut. A drive coupling 152 is connected to the lead screw 149 and extends to a shaft 153 which extends to a vacuum flange 154 which is mounted to the vacuum chamber housing (not shown). An ultra-high vacuum rotary feedthrough 156 is connected through the flange 154 to the shaft 153. The feedthrough is driven by a cog wheel 157 connected through a cog belt 158 to a cog wheel 159 which is rotated by a drive motor 160. A rotary encoder 162 with a reduction gearhead 163 is connected to the drive motor 160 to allow monitoring of the number of revolutions of the drive motor, and thereby the translational position of the carriage 145. A one revolution disk 164 is also connected to the reduction gear head 163 and is formed to provide a single reference pulse with fail safe optical limits.

A lower scan housing 167 is mounted to a shaft 168 on one side which is supported for rotation in a bearing 169 mounted to the carriage 145 and by a similar shaft and bearing (not shown) on the other side of the carriage. The lower crystal 170 is mounted with its crystal support to the scan housing 167. A larger diameter wheel 172 is connected to the shaft by which the lower scan housing 167 is pivoted, to rotate with the same. The wheel 172 is connected by a band 173 to a smaller diameter wheel 174 (partially shown in FIG. 10). The wheels 172 and 174 thus rotate with each other and the larger wheel 172 preferably has twice the pitch diameter of the smaller wheel 174. The band 173 may be fixed to the wheels 172 and 174 at positions on the wheels which will never be out of contact with the bands, as by the cleat 175 shown in FIG. 10. The smaller wheel 174 is mounted to a shaft 177 which is supported for rotation by a bearing 178 in the carriage 145. The shaft 177 is also connected to a linear slider 180, so that the slide 180 rotates with the shaft 177 and with the wheel 174. A straight edge arm 181 is engaged with the slide 180 to rotate with the same and to slide freely in and out. The straight edge arm 181 is connected by a pivot 183 to the shaft 137 by which the wheel 136 is mounted for rotation.

In view of FIG. 9, the monochromator is in the highest angle of incidence, wherein the input beam 11 enters at an upper portion of the monochromator (as compared to the beam 11 entering at the lower portion of the monochromator apparatus of FIG. 5) with the exit beam 116 at a lower position. In view of FIG. 10, the carriage 145 has been translated by rotation of the lead screw 149 to rotate the crystals to their lowest angle of incidence position and to translate the crystal 170 to the proper position to provide the output beam 16 at the proper height.

Figure 11:
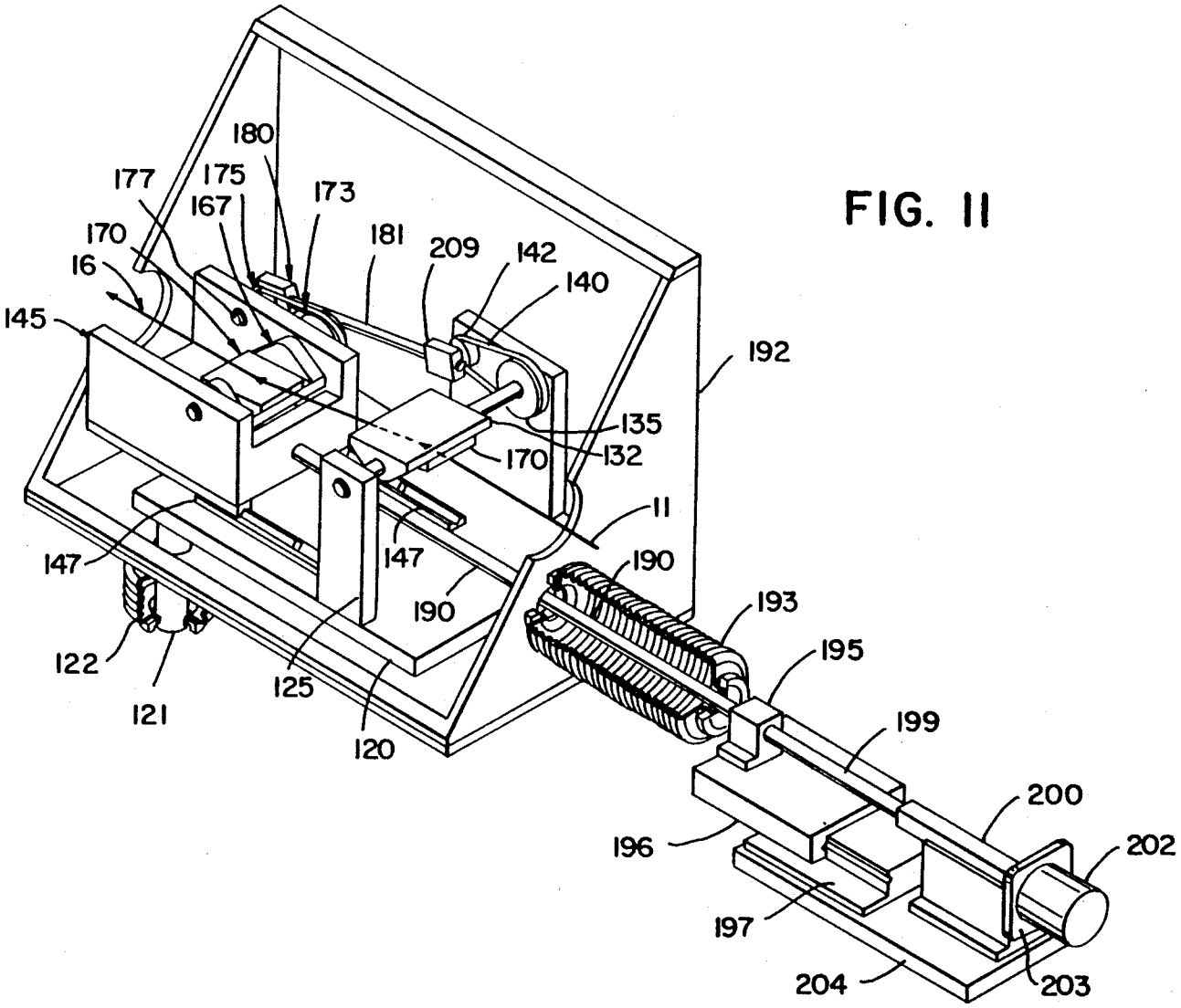
FIG. 11 is a perspective view of an alternative mechanism in accordance with the present invention similar to that of FIG. 9 but utilizing a linear carriage driven by a push rod.

FIG. 11 shows a modified version of the apparatus in which a push-pull rod 190 is used to drive the carriage 145 in translation within the vacuum chamber enclosure 192. The push-pull rod 190 is sealed to the vacuum chamber 192 by a welded bellows seal 193. The push-pull rod 190 is connected to a clamp block 195 Which is mounted on a linear slide 196 which slides on a slide base 197. A push-pull rod 199 extends into a bearing housing 200, with lead screw and nut enclosed, which is connected to a drive motor 202 mounted on a flange 203 of a base 204 to which the slide base 197 is also mounted. The drive motor 202 rotates the enclosed lead screw in the housing 200 which drives the push-pull rod 199 either inwardly or outwardly, thereby driving the linear slide 196 and the clamp block 195 in and out, and similarly drives the push-rod 190 in translation, either inwardly or outwardly, depending on the direction of rotation of the drive motor 202.

In the apparatus of FIG. 11, the straight edge arm 181 is connected to a pivot 180 which rotates with the shaft 177. A linear slider 209 is mounted to the shaft 137 to rotate with the wheel 136, with the slider 209 containing the linear bearing which is engaged to the straight edge arm 181. This illustrates one of the various ways that the components of the present invention may be interchanged without departing from the scope or spirit of the present invention. In addition, other means may be utilized for transferring rotation rather than the wheels with the bands engaged between them. Examples of such alternatives include intermeshed gears, friction wheels, or any other type of positive transmission mechanism which would have minimum dead zone and backlash. The advantage of the bands connecting the wheel as described above is that the band may be fixed to the wheels so that no slipage of the bands with respect to the wheels occurs, essentially resulting in a zero backlash transmission of mechanical motion between the larger and smaller wheels.

Figure 12:
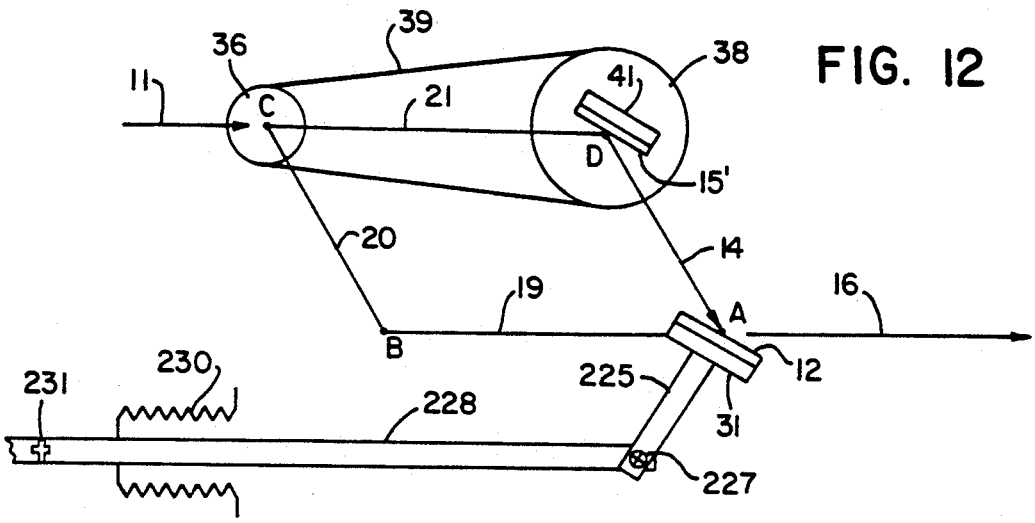
FIGS. 12–13 are schematic views of a modified embodiment of the present invention for use as a plane grating monochromator.
Figure 13:
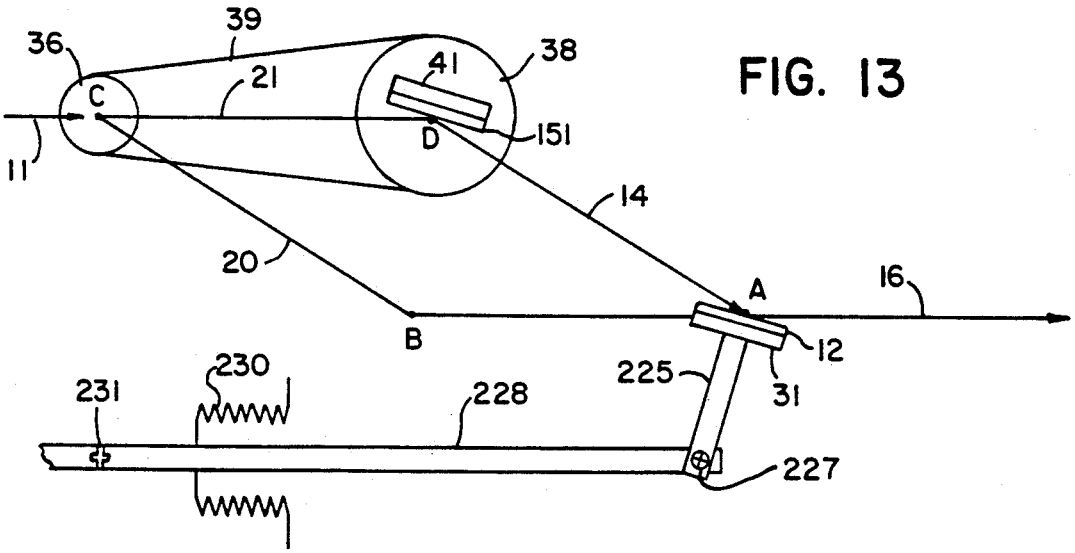

The present invention may be modified to function as a plane grating monochromator rather than a double diffractor monochromator. Such a device may be constructed simply by disabling or eliminating the wheels and band which connects the fixed pivot points, by substituting a mirror for the translatable diffractor, and mounting the non-translating diffractor for pivoting independently of the mirror. This diffractor is typically a grating since the plane grating monochromators are conventionally utilized with visible and near visible wavelengths. The modification of the apparatus of the present invention to function as a plane grating monochromator may be illustrated with respect to the schematic views of FIGS. 12–13 which illustrate a modification of the device of FIG. 4. In the apparatus of FIGS. 12–13, a mirror 15, replaces the diffractor 15, and the wheels 30 and 33 and the band 34 are eliminated. The input beam 11 is incident upon the mirror 15', rather than the diffractor 12, and the output beam 16 is taken from the diffractor 12. The diffractor 12 is mounted to pivot about the vertex A and is rotated by a rod 225 which is connected by a flex pivot 227 to a push rod 228. The push rod 228 extends out of the vacuum enclosure and is sealed by a bellows 230. A flex joint 231 in the rod 228 allows it to flex up and down slightly. Otherwise, the apparatus is the same as that of FIG. 4 and functions in the same way. The input beam 11 strikes the face of the mirror 15, and is reflected in a beam 14 at an angle of reflection which is equal to the angle of incidence. The reflected beam 14 strikes the centerline of the grating 12. The face of the grating 12 will not necessarily be parallel with the face of the mirror 15'. However, by the nature of the grating 12, some wavelength of light incident upon the grating 12 will be reflected along the line 14 to form the output beam 16, while other wavelengths will be reflected in other directions. The push-rod 228 can be pushed in or pulled out to pivot the grating 12 to a desired angle to direct the output beam. As the vertices C and D are translated toward the right end of the their travel, as illustrated in FIG. 12, the reflected beam 14 will strike the grating 12 at a steeper angle of incidence, resulting in certain wavelengths being reflected to the output path 16. When the vertices C and D are translated further to the left, as illustrated in FIG. 13, the angle of incidence of the reflected beam 14 will be shallower with respect to the grating 12. Nonetheless, because of the cooperation between the wheels 36 and 38, the band 39 which connects them, and the slide arm 20, the mirror 15' will be rotated to the proper angle so that the reflected beam 14 always strikes the grating 12 at its axis of rotation.

It will thus be seen that there are many modifications which may be made in the present invention without departing from the spirit and scope of the invention. It is understood that the invention is not confined to the particular embodiments set forth herein as illustrative, but embraces all such forms thereof as come within the scope of the following claims.

What is claimed is:

1. A mounting apparatus for mounting diffractors as in a double diffraction monochromator and the like comprising:

(a) a first mounting member for a diffractor or the like mounted for rotation to a pivot which is fixed in position;

(b) a second mounting member for a diffractor or the like mounted for rotation to a pivot and means for mounting the pivot and the second mounting member for translation along a line;

(c) a first wheel connected to the first mounting member to rotate therewith about its pivot;

(d) a second wheel mounted to rotate about a fixed pivot, the pivot of the second wheel and the pivot of the first wheel lying on a line which is parallel to the line of translation of the pivot for the second mounting member;

(e) an arm connected to the second wheel to rotate with the second wheel about its pivot;

(f) a slider mounted to the arm for translation along an axis toward and away from the pivot of the second wheel;

(g) a third wheel mounted to rotate about a pivot and connected to the slider, and means for constraining the movement of the third wheel so that the pivot of the third wheel lies on the translation line of and can move only in translation with the second wheel;

(h) a fourth wheel connected to the second mounting member to rotate therewith about its pivot; an (i) means for connecting the first wheel to the second wheel such that the angular displacement of the second wheel is twice the angular displacement of the first wheel, and means for connecting the third wheel to the fourth wheel such that the angular displacement of the third wheel is twice the angular displacement of the fourth wheel.

2. The apparatus of claim 1 wherein each of the wheels has a smooth circular circumferential periphery, and wherein the pitch diameter of the first wheel is twice the pitch diameter of the second wheel and the pitch diameter of the fourth wheel is twice the pitch diameter of the third wheel, and wherein the means for connecting the first wheel to the second wheel includes a band engaging the circumferential periphery of both the first and second wheels to connect the same for angular displacement, and the means for connecting the third and fourth wheels includes a band firmly engaged to the circumferential periphery of the third and fourth wheels to connect the same for angular displacement.

3. The apparatus of claim 1 wherein the first and second mounting members each have a crystal mounted thereto having crystal structure suitable for diffracting X-rays.

4. The apparatus of claim 2 including a mechanical connector between the bands and each wheel at a position on each of the wheels where the band will be in contact with the wheel over the entire range of angular displacement of the wheel.

5. A mounting apparatus for mounting diffractors such as in a double diffraction monochromator and the like, comprising:

(a) a first mounting member for a diffractor or the like mounted for rotation to a pivot which is fixed in position;

(b) a translating support frame;

(c) a second mounting member for a diffractor or the like mounted for rotation by a pivot to the translating support frame;

(d) an arm mounted for rotation toward one end of the arm to a pivot which is fixed in position, and means for connecting the arm in sliding engagement to the translating support frame;

(e) means for supporting the translating support frame for translation along a line which is parallel to and fixed distance from a line through the pivot on which the first mounting member is mounted and the pivot on which the arm is mounted; and wherein the pivot for the first mounting member, the pivot for the second mounting member, the pivot for the arm, and the position of sliding engagement of the arm to the translating support frame form four vertices of a parallelogram, the sides of which remain parallel as the translating support frame is translated; and (f) means for operatively connecting the first mounting member to the arm such that the arm and the first mounting member rotate together with the angular displacement of the first mounting member one-half the angular displacement of the arm as the translating support frame is translated, and means for operatively connecting the arm and the second mounting member such that the arm and second mounting member rotate together and the angular displacement of the second mounting member is one-half the angular displacement of the arm as the translating support frame is translated.

6. The mounting apparatus of claim 5 wherein the means for operatively connecting the first mounting member to the arm includes a first wheel connected to the first mounting member to rotate therewith about its pivot, a second wheel mounted to rotate with the arm about its pivot, wherein the pitch diameter of the first wheel is twice the pitch diameter of the second wheel, and a band engaging the circumferential periphery of the first and second wheels to connect the same for displacement together; and wherein the means for operatively connecting the arm and the second mounting member includes a third wheel mounted to the translating support frame on a pivot at the vertex at which the arm is engaged to the translating support frame and slidably connected to the arm to rotate with the arm while allowing the arm to slide freely along its axis, a fourth wheel connected to the second mounting member to rotate therewith about its pivot, wherein the pitch diameter of the fourth wheel is twice the pitch diameter of the third wheel, and a band firmly engaged to the circumferential periphery of the third and fourth wheels to connect the same for angular displacement.

7. The apparatus of claim 5 wherein the first and second mounting members each have a crystal mounted thereto having crystal structures suitable for diffracting X-rays.

8. The apparatus of claim 6 including a mechanical connector between the bands and each wheel at a position on each of the wheels where the band will be in contact with the wheel over the entire range of angular displacement of the wheel.

9. The apparatus of claim 6 wherein the means for connecting the arm to the translating support frame includes a slider engaged to the arm with bearing surfaces therein which engage the arm to allow the arm to slide freely back and forth within the slider, and wherein the slider is connected for rotation to the pivot to which the third wheel is mounted for rotation.

10. The apparatus of claim 5 including a vacuum enclosure and wherein the means for supporting the translating support frame comprises a support bar which is engaged to the translating support frame within the vacuum chamber enclosure and extends to positions outside the enclosure where the support bar is supported for sliding back and forth movement.

11. The apparatus of claim 5 wherein the apparatus includes a vacuum chamber enclosure, an internal support platform, means for supporting the internal support platform independently of the vacuum enclosure, and wherein the translating support frame is formed as a carriage and including linear slides engaged between the translating support frame carriage and the support platform to support the carriage for translational motion, and including drive means for selectively driving the translating support frame carriage from a position outside of the vacuum chamber enclosure.

12. The apparatus of claim 11 wherein the means for driving the translating support frame carriage comprises a lead screw within the vacuum chamber enclosure engaged to a threaded nut on the translating support frame carriage so that rotation of the lead screw causes translation of the carriage, a motor outside of the vacuum enclosure, and a connector to connect the motor to the lead screw to rotate the lead screw.

13. The apparatus of claim 11 wherein the means for driving the support carriage includes a push-pull rod extending from connection to the translating support frame carriage through the vacuum chamber enclosure to a drive outside the vacuum chamber enclosure.

14. A mounting apparatus for mounting a mirror and a diffraction grating in a plane grating monochromator comprising:

(a) a first mounting member for a diffraction grating mounted for rotation to a pivot which is fixed in position;

(b) a translating support frame;

(c) a second mounting member for a mirror mounted for rotation by a pivot to the translating support frame;

(d) an arm mounted for rotation toward one end of the arm to a pivot which is fixed in position and a slider connecting the arm in sliding engagement to the translating .support frame;

(e) means for supporting the translating support frame for translation along a line which is parallel to and a fixed distance from a line through the pivot on which the first mounting member is mounted and the pivot on which the arm is mounted; and wherein the pivot for the first mounting member, the pivot for the second mounting member, the pivot for the arm, and the position of sliding engagement of the arm to the translating support frame form four vertices of a parallelogram, the sides of which remain parallel as the translating support frame is translated; and (f) a wheel mounted on the translating support frame, to rotate about a pivot and connected to the slider to rotate therewith, a wheel connected to the second mounting member to rotate therewith about its pivot, and means for connecting the two wheels such that the angular displacement of the wheel connected to the slider is twice the angular displacement of the wheel connected to the second mounting member as the translating support frame translates.

15. The apparatus of claim 14 wherein each of the wheels has a smooth circular circumferential periphery, and wherein the pitch diameter of the wheel connected to the second mounting member is twice the pitch diameter of the other wheel and wherein the means for connecting the wheels includes a band engaging the circumferential periphery of both wheels to connect the same for angular displacement.

16. The apparatus of claim 14 wherein the first mounting member has a diffraction grating mounted thereto and the second mounting member has a mirror mounted thereto.

17. The apparatus of claim 15 including a mechanical connector between the band and each wheel at a position on each of the wheels where the band will be in contact with the wheel over the entire range of angular displacement of the wheel.

* * * * *